US007095385B2

(12) United States Patent
Chen

(10) Patent No.: US 7,095,385 B2
(45) Date of Patent: Aug. 22, 2006

(54) ANTENNA ENGAGING MECHANISM IN WIRELESS COMMUNICATION DEVICE

(75) Inventor: Hsiao-Wu Chen, Taoyuan (TW)

(73) Assignee: BENQ Corporation, Taoyuan (TW)

( * ) Notice: Subject to any disclaimer, the term of this patent is extended or adjusted under 35 U.S.C. 154(b) by 0 days.

(21) Appl. No.: 10/949,965

(22) Filed: Sep. 23, 2004

(65) Prior Publication Data

US 2005/0062675 A1 Mar. 24, 2005

(30) Foreign Application Priority Data

Sep. 24, 2003 (TW) ..... 92126369 A

(51) Int. Cl.
*H01Q 1/50* (2006.01)

(52) U.S. Cl. ..... 343/906; 343/888

(58) Field of Classification Search ..... 343/702, 343/888, 900, 906

See application file for complete search history.

(56) References Cited

U.S. PATENT DOCUMENTS 5,661,497 A * 8/1997 Calearo ..... 343/715

2004/0227676 A1* 11/2004 Kim et al. ..... 343/702

* cited by examiner

*Primary Examiner*—Shih-Chao Chen
(74) *Attorney, Agent, or Firm*—Ladas & Parry LLP

(57) ABSTRACT

The present invention provides an antenna engaging mechanism in a wireless communication device, which has a circuit board. The antenna engaging mechanism comprises a housing that has a nut, an antenna, and an elastic metal piece. The antenna comprises an antenna metal tube and an antenna shell covering one end of the antenna metal tube, wherein the other end has an engaging protrusion column with a taper head and a taper bottom. The elastic metal piece comprises a fixing portion for fixing the elastic metal piece and an elastic arm for holding the engaging protrusion column. While the engaging protrusion column is rotated into the nut of the housing, the taper head holds open the elastic arm. After the taper head passes, the elastic arm springs back due to the elasticity and enables the engagement of the elastic metal piece and the engaging protrusion column at the taper bottom.

10 Claims, 4 Drawing Sheets

ANTENNA ENGAGING MECHANISM IN WIRELESS COMMUNICATION DEVICE

CROSS-REFERENCE TO RELATED APPLICATIONS

This application claims priority under 35 U.S.C. § 119 to the prior Taiwanese Application No. 092126369 filed on Sep. 24, 2003.

BACKGROUND OF THE INVENTION

1. Field of the Invention

The present invention relates to an antenna engaging mechanism in a wireless communication device.

2. Description of the Prior Art

Generally, the most important scheme of a wireless communication device having an external antenna is to fix the antenna to the wireless communication device tightly. For example, a mobile phone and its external antenna are fixed tightly to avoid loss the transmission of signals, meanwhile, the antenna is not easy to be accidently removed by the user and thus prevents the antenna from being damaged, or accidentally ingested by children. Generally, the external antenna comprises two types, namely engaging type and rotatable type.

Please refer to FIG. 1. FIG. 1 is a schematic diagram of an engaging antenna 10 of the prior art. The engaging antenna 10 of the prior art comprises an engaging hook 12 and a plastic shell 14. The plastic shell 14 is usually manufactured by injection molding and includes an antenna metal tube therein. The plastic shell 14 comprises an outer portion 16 and an engaging portion 18. The shape of the engaging portion 18 conforms to the shape of the antenna hole of the wireless communication device. When the engaging antenna 10 of the prior art is combined with the wireless communication device, the engaging hook 12 is forced to change shape so that the engaging hook 12 can pass through the antenna hole of the wireless communication device with the engaging portion 18 together. After passing through the antenna hole, the engaging hook 12 springs back due to its elasticity and is then engaged with the wireless communication device. Therefore, the engaging antenna 10 can engage the wireless communication device, and the user cannot separate the engaging antenna 10 from the wireless communication device from the outside of the communication device.

Please refer to FIG. 2. FIG. 2 is a schematic diagram of a rotatable antenna 20 of the prior art. The principal part of the rotatable antenna 20 of the prior art is a metal tube 22 that has a screw thread 26. An antenna shell 24 covers one end of the metal tube 22. The other end of the metal tube 22 has the screw thread 26 where the rotatable antenna 20 is attached to the wireless communication device. Moreover, the antenna hole of the wireless communication device has a corresponding nut. The engagement of both the rotatable antenna 20 and the wireless communication device utilizes the screw thread 26 of the metal tube 22 and the corresponding nut inside the antenna hole. This method, which utilizes the screw thread and the nut for combination, enables a tight engagement between the antenna and the wireless communication device.

Compared to the engaging antenna 10 in FIG. 1 and the rotatable antenna 20 in FIG. 2, the engaging antenna 10 is fixed to the mobile phone only by the plastic shell 14, the antenna is easily loosened, and the transmission of signals is usually unstable. On the contrary, the engagement of the rotatable antenna 20 and the wireless communication device is more stable by utilizing a screw thread and a nut combination. However, the user can easily unscrew the rotatable antenna 20 to separate it from the wireless communication device, and thus the antenna may be lost or accidentally ingested by children.

Therefore, the present invention provides an antenna engaging mechanism to tightly engage the antenna to the wireless communication device and prevent the antenna from being separated from the wireless communication device, so as to address the problems of the prior art.

SUMMARY OF THE INVENTION

The objective of the present invention is to provide an antenna engaging mechanism in a wireless communication device to tightly engage the antenna to the wireless communication device and prevent the antenna from being separated from the wireless communication device directly.

In one aspect the present invention provides an antenna engaging mechanism in a wireless communication device. The wireless communication device comprises a housing, a circuit board, and a rotatable antenna. The housing comprises a nut on the internal. The circuit board is installed in the housing for processing the radio signal received or transmitted by the wireless communication device. The rotatable antenna comprises an antenna metal tube and an antenna shell, which covers one end of the antenna metal tube. The antenna engaging mechanism comprises a screw thread, an engaging protrusion column, and an elastic metal piece. The screw thread is disposed on the antenna metal tube to enable the antenna metal tube to rotatably engage with the nut of the housing. The other end of the antenna metal tube has an engaging protrusion column with a taper head and a taper bottom. The maximum radial width of the taper head is larger than the radial width of the engaging protrusion column. The elastic metal piece comprises a fixing portion for fixing the elastic metal piece on the circuit board and an elastic arm for holding the engaging protrusion column. While the antenna metal tube of the rotatable antenna is screwed to the nut of the housing, the taper head pushes and opens the elastic arm. After the taper head passes the elastic arm, the elastic arm springs back to engage the taper bottom due to the elasticity, and the engaging protrusion column enables the elastic arm of the elastic metal piece to hold the engaging protrusion column of the antenna tightiy, so that the rotatable antenna will not get loosened from the housing.

The antenna engaging mechanism of the present invention in the wireless communication device can prevent the antenna from loosening from the housing and eliminate the possibility of being easily separated from the wireless communication device.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
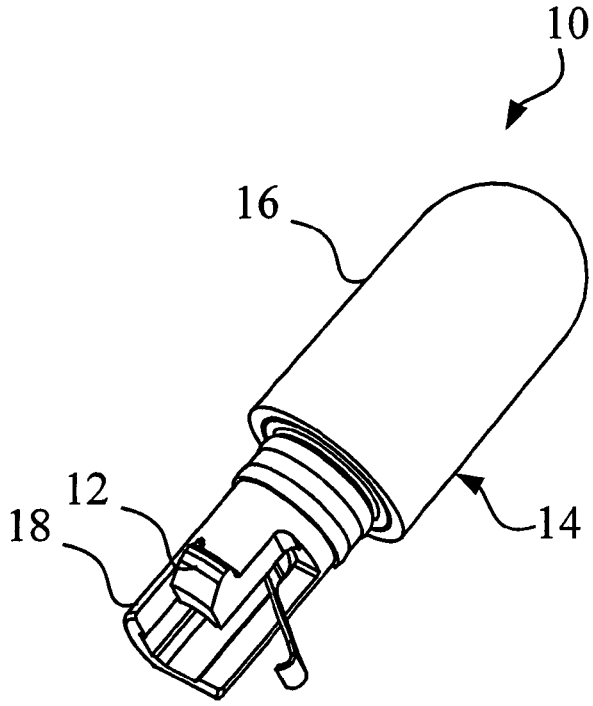
FIG. 1 (prior art)
FIG. 1 is a schematic diagram of an engaging antenna of the prior art.
Figure 2:
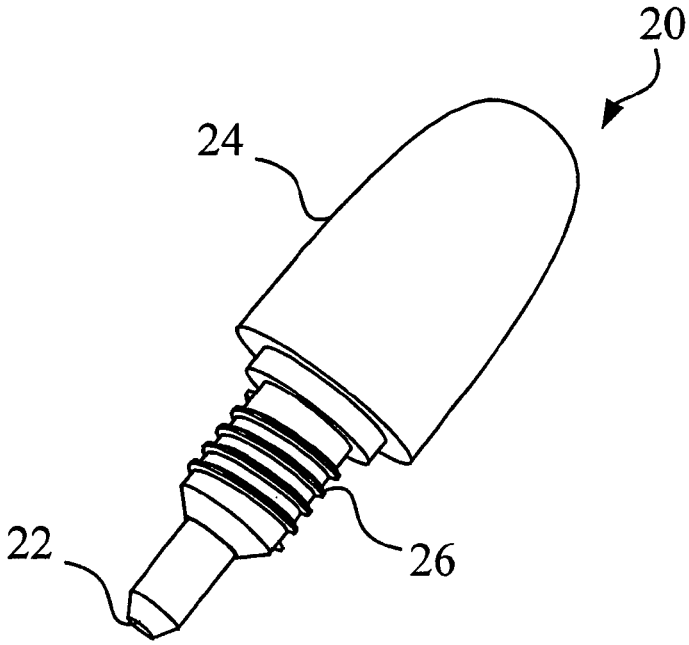
FIG. 2 (prior art)
FIG. 2 is a schematic diagram of a rotatable antenna of the prior art.
Figure 3:
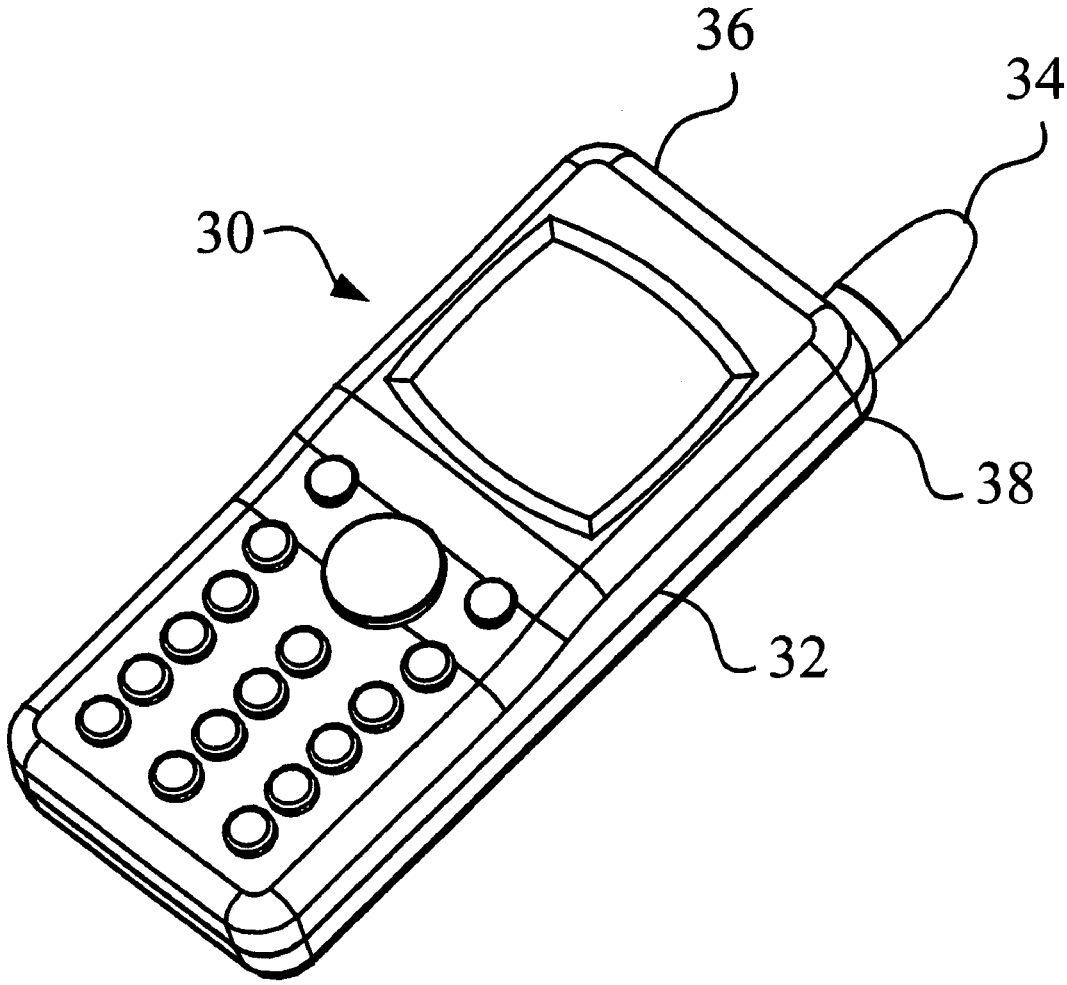
FIG. 3 is a schematic diagram of a wireless communication device in a preferred embodiment of the present invention.
Figure 4:
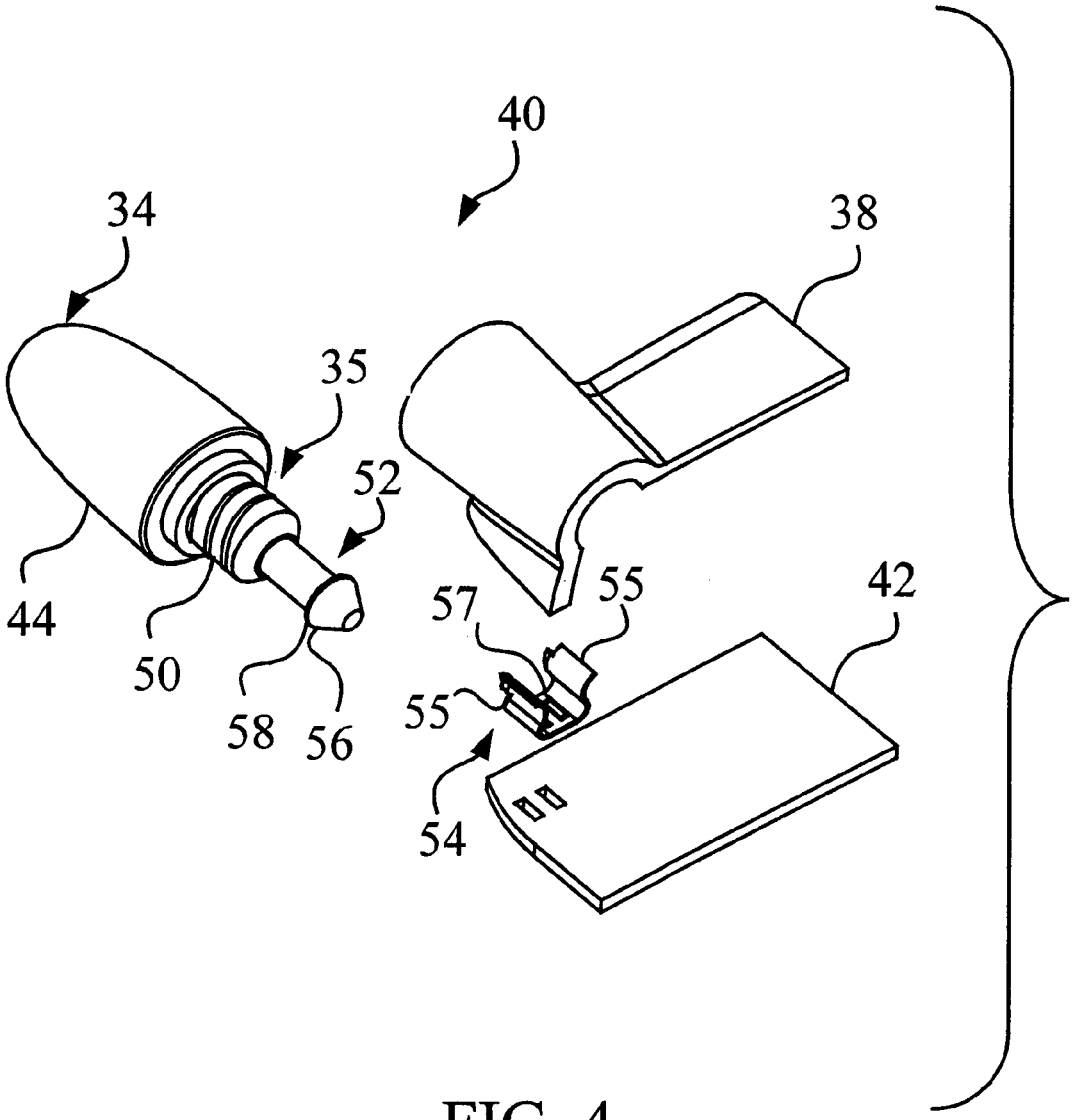
FIG. 4 is a blown-up diagram of an antenna engaging mechanism in a wireless communication device in the preferred embodiment according to the present invention.

The present invention provides an antenna engaging mechanism in a wireless communication device. A preferred embodiment of the antenna engaging mechanism is described in the following by taking a mobile phone as an example. Please refer to FIG. 3 and FIG. 4. FIG. 3 is a schematic diagram of a wireless communication device 30 in a preferred embodiment of the present invention. FIG. 4 is a blown-up diagram of an antenna engaging mechanism 40 in a wireless communication device 30 in the preferred embodiment according to the present invention. The antenna engaging mechanism 40 of the present invention is used in the wireless communication device 30. As shown in FIG. 3, the wireless communication device 30 comprises a housing 32 and a rotatable antenna 34. The housing 32 comprises a front housing 36 and a rear housing 38. The front housing 36 and the rear housing 38 may be joined using a plurality of screws disposed in screw holes.

As shown in FIG. 4, the wireless communication device 30 further comprises a circuit board 42 in the housing 32 for processing the radio signal received or transmitted by the wireless communication device 30. The circuit board 42 shown in FIG. 4 is only a portion of the circuit board of the wireless communication device 30. Furthermore, the rear housing 38 shown in FIG. 4 is a small portion of the rear housing 38 shown in FIG. 3. A nut is installed inside and on the top of the rear housing 38. The wireless communication device 30 further comprises a rotatable antenna 34. The antenna 34 comprises an antenna metal tube 35 and an antenna shell 44 covering one end of the antenna metal tube 35.

As shown in FIG. 4, the antenna engaging mechanism 40 comprises a screw thread 50, an engaging protrusion column 52, and an elastic metal piece 54. The screw thread 50 is disposed on the antenna metal tube 35 and corresponds to the nut inside the rear housing 38 to enable the antenna metal tube 35 to rotatably engage with the nut of the rear housing 38. The engaging protrusion column 52 is on the other end of the antenna metal tube 35. Therefore, the antenna shell 44 covers one end of the antenna metal tube 35, and the other end of the antenna metal tube 35 has the engaging protrusion column 52. The engaging protrusion column 52 has a tapered head 56 and a tapered bottom 58 (see FIG. 6). The maximum radial width of the tapered head 56 (see w1 in FIG. 5) is larger than the radial width of the engaging protrusion column 52 (see w2 in FIG.5).

The elastic metal piece 54 comprises a fixing portion 57 and at least one elastic arm 55. The fixing portion 57 is used for fixing the elastic metal piece 54 on the circuit board 42. The at least one elastic arm 55 is used for holding the engaging protrusion column 52. The elastic metal piece 54 is designed in an inverted 106 shape, so as to hold the engaging protrusion column 52 tightly. The elastic metal piece 54 is fixed on the circuit board 44 by welding or by surface mounting technology.

Figure 5:
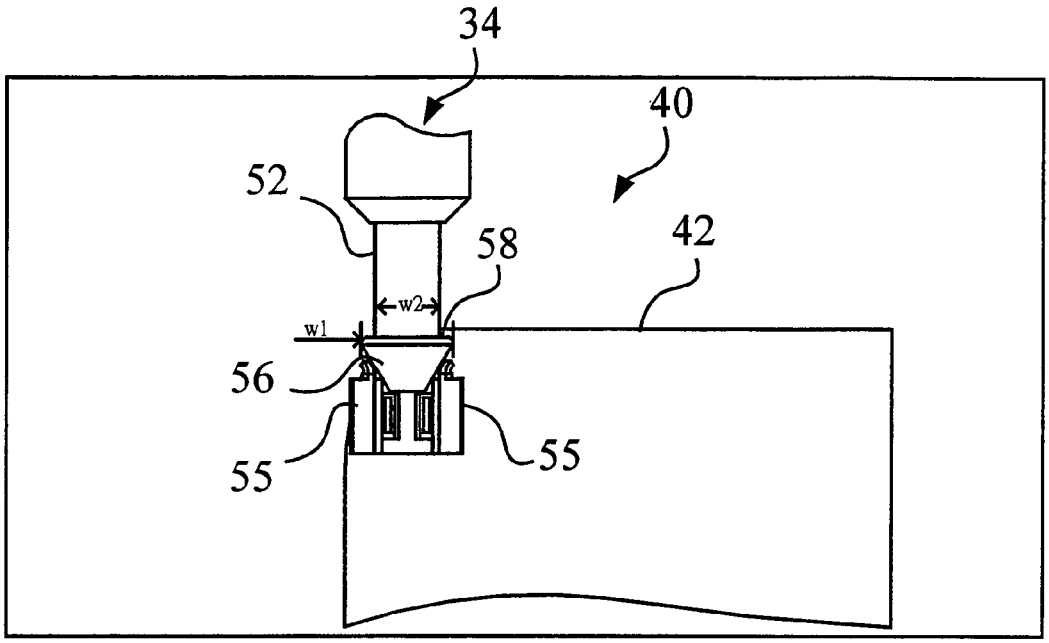
FIG. 5 is a schematic diagram of the antenna engaging mechanism shown in FIG. 4 before being engaged.
Figure 6:
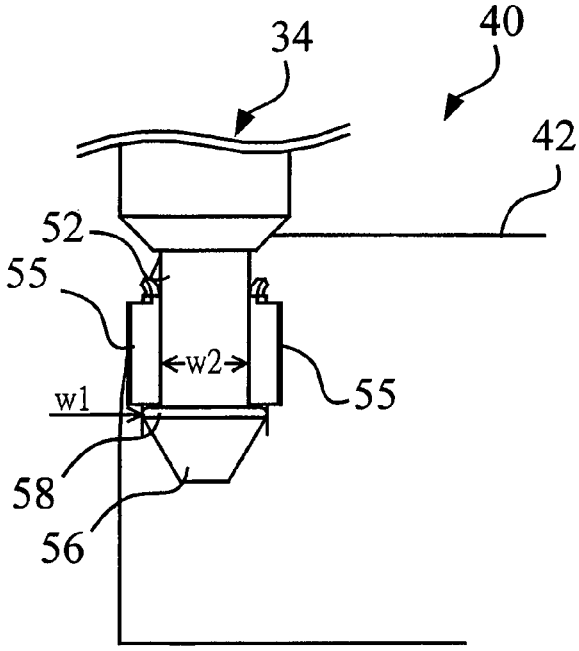
FIG. 6 is a schematic diagram of the antenna engaging mechanism shown in FIG. 4 after being engaged.

Please refer to FIG. 5 and FIG. 6. FIG. 5 is a schematic diagram of the antenna engaging mechanism 40 shown in FIG. 4 before being engaged. FIG. 6 is a schematic diagram of the antenna engaging mechanism 40 shown in FIG. 4 after being engaged. The above two diagrams may be used to understand better how the antenna 34 engages with the housing 32 of the wireless communication device according to the present invention. While the rotatable antenna 34 is screwed into the housing 32 of the wireless communication device, the tapered head 56 pushes and opens the at least one elastic arm 55 of the elastic metal piece 54. After the tapered head 56 passes the at least one elastic metal arm 55, because the maximum radial width w1 of the taper head 56 is larger than the radial width w2 of the engaging protrusion column 52, the at least one elastic arm 55 of the elastic metal piece 54 springs back due to its elasticity and holds the engaging protrusion column 52 tightly. The engaging protrusion column 52 enables the rotatable antenna 34 to be constrained in the housing 32 because the tapered bottom 58 is restrained by the at least one elastic arm 55. As can be seen, the tapered bottom 58 preferably has a flat surface for engaging an edge of the at least one elastic arm 55 to inhibit withdrawal of the antenna 34 after the at least one elastic arm 55 of the elastic metal piece 54 springs back to engage the engaging protrusion column 52. Therefore, the antenna 34 is not easily separated from the wireless communication device 30 by the user.

The antenna tube 35, the engaging protrusion column 52, and the elastic metal piece 54 of the rotatable antenna 46 are, for example, made of copper. Since the elastic metal piece 54 has already been fixed and electrically connected with other elements on the circuit board 44, the rotatable antenna 34 may achieve the function of signal transmission by the engagement of the elastic metal piece 54 with the engaging protrusion column 52.

As shown in FIG. 3, the antenna 34 of the wireless communication device has already been installed on the housing 32. Because the tapered, bottom 58 of the engaging protrusion column 52 is restrained by the elastic metal piece 54, the antenna 34 cannot be unscrewed from the wireless communication device 30. If the user wants to remove the antenna 34 from the housing 32, the user must disassemble the front housing 36 from the rear housing 38 first to expose the antenna engaging mechanism 40, as shown in FIG. 6. Then, the antenna 34 should be pulled up along a direction vertical to the circuit board 44, so that the elastic arm 55 of the elastic metal piece is pressured to open, and the antenna 34 may be removed from the housing 32. Because the user cannot directly remove the antenna from the wireless communication device according to the antenna engaging mechanism of the present invention, the antenna will not be lost as a result of being easily removed.

Compared to the rotatable antenna and the engaging antenna of the prior art, according to the antenna engaging mechanism 40 of the present invention, the at least one elastic arm 55 holds the engaging protrusion column 52 tightly and prevents the antenna from being removed directly from the wireless communication device, the object of this invention is achieved.

With the example and explanations above, the features and spirits of the invention will be hopefully well understood. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An antenna engaging mechanism in a wireless communication device, the wireless communication device comprising a housing, a circuit board and an antenna, the antenna engaging mechanism comprising:

a nut disposed on the housing;

an engaging protrusion column including a tapered head and a tapered bottom; and an elastic metal piece fixed on the circuit board, the elastic metal piece having at least one elastic arm for holding the engaging protrusion column;

wherein when the antenna is screwed to the wireless communication device, the tapered head of the engaging protrusion column pushes the at least one elastic arm to open the elastic metal piece, the at least one elastic arm springs back to hold the engaging protrusion column after the tapered head passes the elastic metal piece.

2. The antenna engaging mechanism of claim 1, wherein the antenna further including a metal tube having a screw thread to enable the antenna to be rotatably screwed to the housing.

3. The antenna engaging mechanism of claim 1, wherein the elastic metal piece is designed as an inverted 106 shape, so as to hold the engaging protrusion column of the antenna tightly.

4. The antenna engaging mechanism of claim 1, wherein the taper head has a first maximum radial width, and the engaging protrusion column has a second maximum radial width, the first maximum radial width is greater than the second maximum radial width.

5. The antenna engaging mechanism of claim 1, wherein when the antenna is to be removed from the housing, the front housing is disassembled from the rear housing first to expose the antenna engaging mechanism, and then the antenna is pulled up along a direction vertical to the circuit board, such that the elastic arm of the elastic metal piece is pressured to open, and the antenna is removed from the housing.

6. An antenna engaging mechanism in a wireless communication device, the wireless communication device comprising a housing, a circuit board and an antenna, the antenna engaging mechanism comprising:

a threaded element on the housing;

an engaging protrusion column of the antenna including a tapered head; and an elastic metal piece fixed on the circuit board, the elastic metal piece having at least one elastic arm for holding the engaging protrusion column;

wherein when the antenna is screwed to the housing of the wireless communication device, the tapered head of the engaging protrusion column engages the at least one elastic arm to open the elastic metal piece, the at least one elastic arm springing back to engage and make electrical contact with the engaging protrusion column after the tapered head passes the elastic metal piece, the elastic metal piece thereby electrically connecting the antenna with said wireless communication device.

7. The antenna engaging mechanism of claim 6, wherein when the antenna is to be removed from the housing, a front housing portion is disassembled from a rear housing portion to expose the antenna engaging mechanism, and the elastic arm of the elastic metal piece may be urged to assume an open position and the antenna is removable from the housing.

8. The antenna engaging mechanism of claim 6, wherein the antenna further including a metal tube having a screw thread to enable the antenna to be rotatably screwed to the housing.

9. The antenna engaging mechanism of claim 6, wherein the elastic metal piece is designed as an elongate, inverted 106 shape, so as to hold the engaging protrusion column of the antenna tightly.

10. The antenna engaging mechanism of claim 6, wherein the taper head has a first maximum radial width, and the engaging protrusion column has a second maximum radial width, the first maximum radial width is greater than the second maximum radial width.

* * * * *